US005842527A

United States Patent [19]

Arakawa et al.

[11] Patent Number: 5,842,527

[45] Date of Patent: Dec. 1, 1998

[54] HAMMER DRILL WITH A MODE CHANGE-OVER MECHANISM

[75] Inventors: Takuo Arakawa; Masao Miwa, both of Anjo, Japan

[73] Assignee: Makita Corporation, Aich-pref, Japan

[21] Appl. No.: 695,983

[22] Filed: Aug. 15, 1996

[30] Foreign Application Priority Data

Aug. 18, 1995 [JP] Japan ..... 7-210847

[51] Int. Cl.[6] ..... B25D 9/04

[52] U.S. Cl. ..... 173/48; 173/104

[58] Field of Search ..... 173/48, 104, 109, 173/117

[56] References Cited

U.S. PATENT DOCUMENTS

| | | | |
|---|---|---|---|
| 4,506,743 | 3/1985 | Grossman | 173/48 |
| 4,895,212 | 1/1990 | Wache | 173/48 |
| 5,111,889 | 5/1992 | Neumaier | 173/48 |
| 5,111,890 | 5/1992 | Ranger et al. | 173/104 |
| 5,343,961 | 9/1994 | Ichikawa et al. | 173/48 |
| 5,379,848 | 1/1995 | Rauser | 173/48 |
| 5,456,324 | 10/1995 | Takagi et al. | 173/48 |

*Primary Examiner*—Scott A. Smith
*Attorney, Agent, or Firm*—Lahive & Cockfield, LLP

[57] ABSTRACT

A hammer drill has a mode change-over mechanism including a change link with a horizontally elongated slot, an eccentric pin projecting from a mode selector switch and penetrating the slot. The change link is moved vertically by rotating the mode selector switch, which in turn vertically moves a pair of change keys secured to a holder of the change link, thus either engaging or disengaging the change keys with or from a sleeve provided in a rotation transmission mechanism for transmitting the rotation of a motor to the tool holder. In the engagement position, the rotation of the motor of the hammer drill is transmitted to a tool holder while in the disengagement position, the rotation of the motor is not transmitted. Also, the eccentric pin is engaged with a square recess formed in a lock ring which is fitted around the tool holder and urged backward by a compression spring. The eccentric pin is horizontally moved by rotating the mode selector switch, which in turn moves the lock ring in the axial direction, thereby couple or de-couple the lock ring to or from the tool holder.

9 Claims, 9 Drawing Sheets

HAMMER DRILL WITH A MODE CHANGE-OVER MECHANISM

BACKGROUND OF THE INVENTION

1. Field of the Invention

The present invention relates generally to a hammer drill. More particularly, the present invention relates to a hammer drill having a rotation transmission mechanism provided between a tool holder rotatably mounted in a drill housing and a motor, and also having a hammer blow mechanism for transmitting hammer blows to a tool bit held in the tool holder.

2. Description of the Prior Art

Various configurations for selecting from several operation modes have been proposed for use in an hammer drill. One such example is disclosed in Japanese Examined Patent Application Laying-Open Gazette No. S61-19395, in which the hammer drill includes a cylinder held in a tool holder both of which are integrally rotatable with each other in a drill housing. The hammer drill also includes a connecting member provided with engagement teeth on both front and rear ends thereof, a bevel gear mounted at the rear of the connecting member for transmitting the rotation of the motor to the connecting member, and locking teeth formed integrally on the housing. Also, the connecting member is so constructed as to be able to rotate integrally with the cylinder and slide between the bevel gear and the locking teeth to select one from three operation modes. To prevent the tool holder from rotating, a lock mode is selected where the front teeth of the connecting member is engaged with the locking teeth of the housing. To rotate the tool holder, a rotation mode is selected where the rear teeth of the connecting member is engaged with the bevel gear. Thirdly, a neutral mode can be also selected at the middle position where the connecting member is engaged with neither of the two members.

As described above, the connecting member serves as a switch for selecting two separate functions of transmission of rotation and locking in the foregoing structure. However, it has proven to be a difficult task to design a durable connecting member that can sustain a prolonged use under the two different loads applied thereto due to its double function. In addition, when the part concerned with either function, that is, the front or rear engagement teeth, is damaged or worn out, the entire connecting member must be replaced, thus resulting in an increased maintenance cost.

SUMMARY Of THE INVENTION

It is accordingly an object of the present invention to provide a hammer drill with an improved mode change-over mechanism to reduce the cost for manufacturing or maintenance.

The above and other related objects are attained by providing a hammer drill comprising a motor for providing drive power for the hammer drill, a cylinder fixed in a housing, a rotatable tool holder for receiving and integrally rotating a tool bit therewith, the tool holder being provided with an engagement member, a rotation transmission mechanism for transmitting the rotation of the motor to the tool holder, the rotation transmission mechanism provided between the tool holder and the motor, transmission switching means included in the rotation transmission mechanism for, by the movement thereof, selecting one of two operational states in one state of which the rotation of the motor is transmitted to the tool holder and in the other state of which the rotation of the motor is not transmitted to the tool holder, a locking member movable between a position in which the locking member is engaged with the engagement member of the tool holder and another position in which the locking member is disengaged from the engagement member, and mode change-over means for moving the transmission switching means and the locking member, the mode change-over means connecting the transmission switching means with the locking member.

In the hammer drill thus constructed, the operation mode of the hammer drill can be selected by operating the mode change-over means from a rotation plus hammer mode in which the transmission switching means is moved to a position where the transmission switching means is able to transmit the rotation of the motor to the tool holder and the locking member is moved to a position where the locking member is disengaged from the engagement member of the tool holder, a neutral mode in which the transmission switching means is moved to a position where the transmission switching means is unable to transmit the rotation of the motor to the tool holder and the locking member is moved to a position where the locking member is disengaged from the engagement member of the tool holder, and a tool holder lock-up mode in which the transmission switching means is moved to a position where the transmission switching means is unable to transmit the rotation of the motor to the tool holder and the locking member is moved to a position where the locking member is engaged with the engagement member of the tool holder.

In accordance with the present invention, the mode change-over means includes a mode selector switch connected with the locking member for, when operated, moving the locking member to one of the above two positions. The mode change-over means further includes a linking member with one end connected to the mode selector switch and the other end connected to the transmission switching means for, by operating the mode selector switch, moving the transmission switching means to one of the above two positions.

Preferably, the rotation transmission mechanism comprises a first gear for transmitting the rotation of the motor and a rotating shaft around which the first gear is coaxially rotatably fitted. The rotating shaft can also be engaged orthogonally with the toot holder via a second gear for transmitting the rotation of the motor to the tool holder.

Preferably, the transmission switching means is a key member integrally rotatable with the rotating shaft and slidably movable along the rotating shaft such that the key member is engageable with the first gear.

Also, the locking member is preferably a sleeve coaxially mounted around the toot holder and movable in the axial direction thereof.

Furthermore, the mode selector switch may includes an eccentric pin orthogonally engaged with the sleeve and may be rotatably supported in the housing of the hammer drill.

One end of the linking member may be penetrated by the eccentric pin while the other end of the linking member may be connected with the key member.

In the hammer drill thus constructed, the circular motion of the eccentric pin caused by the rotation of the mode selector switch causes the sleeve to move the sleeve axially to one of the above two positions, and also causes the linking member to move in parallel to the rotating shaft to one of the above two positions.

Furthermore, one end of the above-described first gear may have a plurality of openings formed therein while the above-described key member has a plurality of protrusions so formed thereon as to be engageable with the openings of the first gear for transmitting the rotation of the motor to the tool holder when the key member is moved vertically by vertical movement of the linking member.

In one aspect, of the present invention, the linking member can be an approximately L-shaped member comprising a horizontally extended holder connected with the key member and a link connected to the holder and extended from the holder in parallel with the rotating shaft, the upper portion of the link being penetrated by the eccentric pin.

In a further aspect of the present invention, an urging means may be provided for urging the sleeve in the rearward direction while the part of the sleeve engaged with the eccentric pin is a cut-out formed in the rear end thereof so as to permit the vertical movement of the eccentric pin.

Moreover, the part of the linking member engaged with the eccentric pin can be a horizontal slot for permitting the horizontal movement of the eccentric pin.

The present invention can include a yielding mechanism provided on the portion of the linking member which is engaged with the eccentric pin so as to permit vertical movement of the eccentric pin caused by the rotation of the mode selector switch when a load is applied to the linking member in vertical movement during a mode change to the rotation plus hammer mode.

The above-described yielding mechanism may comprise a slide piece slidable in parallel with the rotating shaft, the slide piece partially forming the part engaged with the eccentric pin, and an urging means for urging the slide piece in the direction opposite to the vertical movement of the eccentric pin.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENTS

Figure 1:
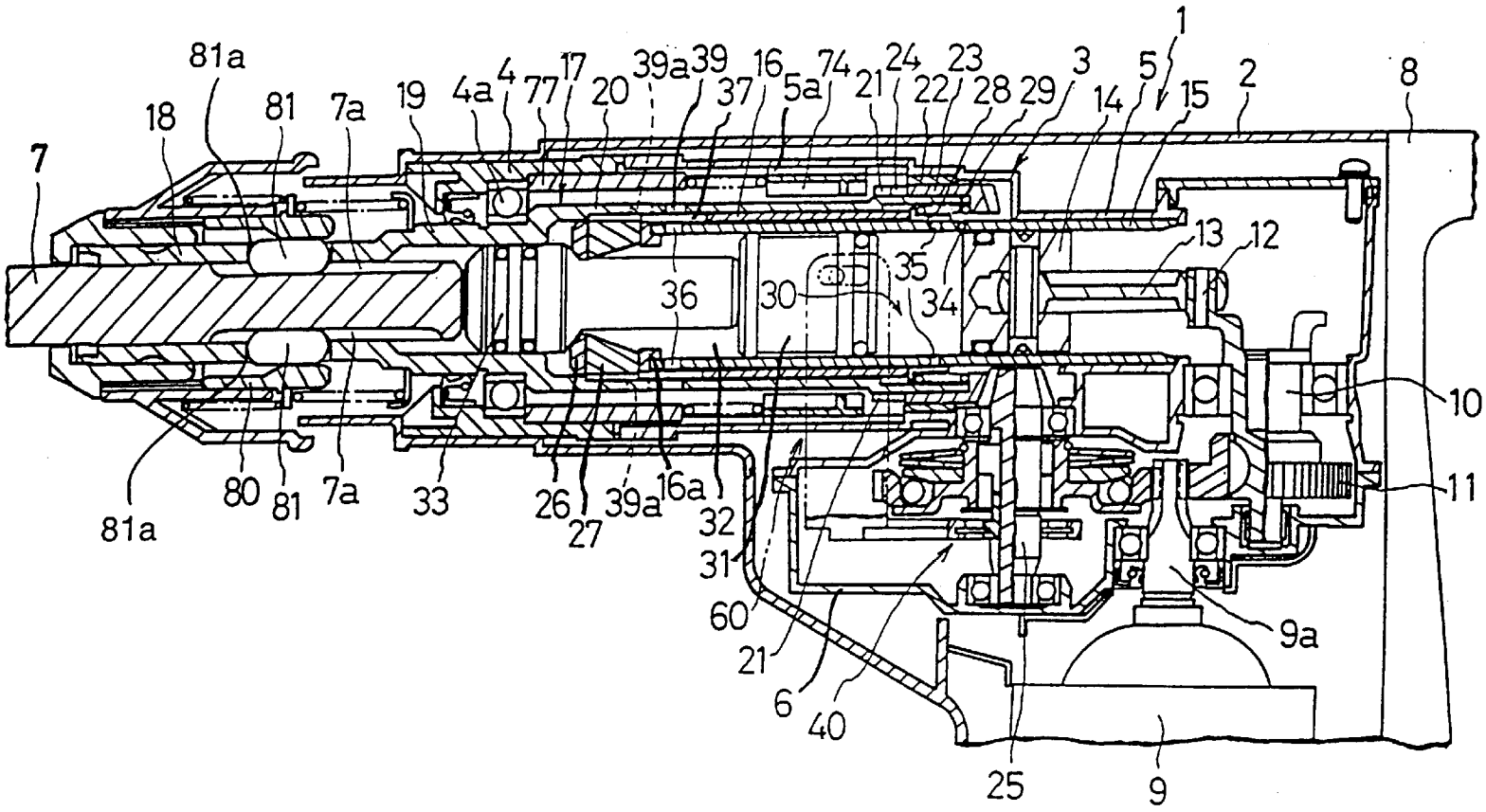
FIG. 1 is a vertical sectional view of a hammer drill embodying the present invention.

FIG. 1 depicts a vertical sectional view of a hammer drill 1 constructed according to the present invention. The hammer drill 1 comprises a housing 2, a housing cap 4, an operation mechanism 3 supported by a crank housing 5 fastened to the housing cap 4 with screws (not shown), and a transmission mechanism 40 supported by a crank housing 5 and a gear housing 6 for transmitting the rotation of a motor 9 to the operation mechanism 3. The hammer drill 1 further has between the transmission mechanism 40 and the operation mechanism 3 a change-over mechanism 60 with which to select one of an hammer only mode, a neutral mode, and a rotation plus hammer mode.

The operation mechanism 3 will now be explained in detail. In the following description, the direction toward the tool bit 7 is referred to as the front, the direction toward a handle 8 the rear, the top of the hammer 1 as seen in FIG. 1 upper, and the bottom of the hammer 1 as seen in FIG. 1 lower.

The motor 9 (not part of the operation mechanism 3), located at the lower rear of the crank housing 5, has a vertically oriented motor shaft 9*a* engaged with a gear 31 formed integrally with a crank shaft 10. An eccentric pin 12 projects from the top of the crank shaft 1O and penetrates one end of a connecting rod 13 of a piston 14, thereby connecting the motor 9 with the piston 14 for converting the rotation of the motor shaft 9*a* to the reciprocating motion of the piston 14. As shown in cross section in FIG. 1, the crank shaft 10 has a hollow therein with an opening at the top thereof to reduce the weight of the hammer drill 1.

An aluminum cylinder 15, encasing the piston 14, is gripped by and secured to the crank housing 5 in the rear portion, extending therefrom toward the tool bit 7. A slide sleeve 16 and a tool holder 17 are coaxially fitted around the front portion of the cylinder 15. The toot holder 17 is composed of a top small bore portion 18, into which the tool bit 7 is inserted, a middle bore portion supported by a ball bearing 4*a* provided on the housing cap 4, and a large bore portion 20 fitted with the slide sleeve 16. The small bore portion 18 protrudes forward out of the housing 2. A pair of rollers 81 are held in retaining holes 18*a* formed in the small bore portion 18 further forward from the front end of the housing 2. The rollers 81 are held in place with a chuck sleeve 80 fitted around the small bore portion 18 and engaged with a pair of the grooves 7*a* formed in the toot bit 7 so that the tool bit 7 is rotatable with the tool holder 17. On the other hand, a plurality of protrusions 21 formed on the large bore portion 20 are engaged with a plurality of teeth 24 of a bevel gear 23 which is in turn engaged with a shaft 25 and supported by a metal support 22. This construction allows the rotation of the motor 6 to be transmitted to the tool holder 17 via the transmission mechanism 40, rotating the tool holder 17 when rotation is required.

The slide sleeve 16 is a synthetic resin tube slidably mounted between the Large bore portion 20 of the tool holder 17 and the cylinder 15. The slide sleeve 16 has an inwardly extending flange 16*a* at its front end for preventing the sleeve 16 from sliding any further backward than the position shown in FIG. 1, upon abutting against the front end of the cylinder 15. A washer 26 and a rubber ring 27 are slidably interposed between the flange 61*a* and the middle bore portion 19. The washer 26 can advance as far as the step separating the middle bore portion 19 from the large bore portion 20. A compression spring 29 is interposed between the bevel gear 23 and the rear end of the slide sleeve 16, urging the slide sleeve 16 in the forward direction. A steel ring 28 is positioned between the compression spring 29 and the slide sleeve 16 around the cylinder 15.

Figure 2:
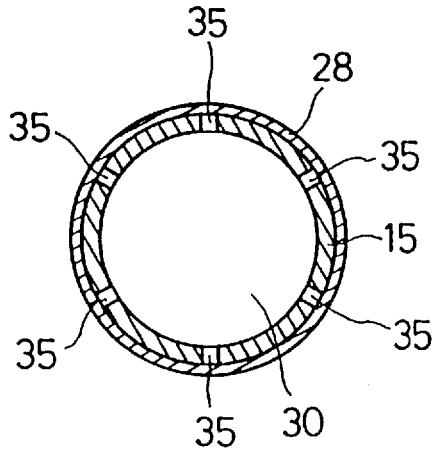
FIG. 2 is a cross sectional view of a cylinder and a steel ring fitted over a first air chamber of the hammer drill in accordance with the embodiment shown in FIG. 1.
Figure 3:
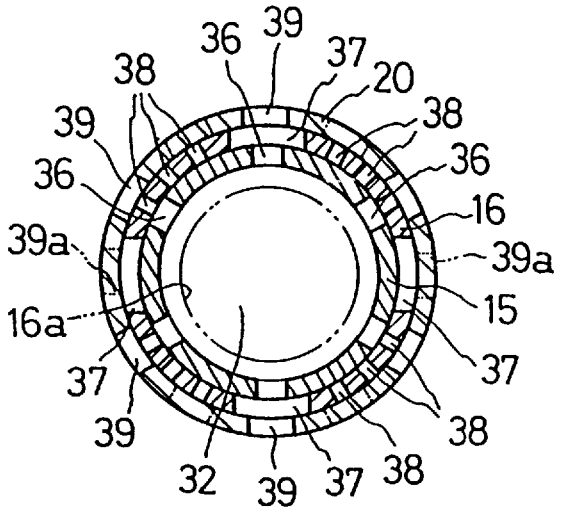
FIG. 3 is a traverse sectional view of the cylinder, a slide sleeve, and a tool holder fitted over a second air chamber of the hammer drill in accordance with the embodiment shown in FIG. 1.

The cylinder 15 contains a reciprocable striking member 31 in front of the piston 14, a first air chamber 30 formed between the piston 14 and the striking member 31, and a second air chamber 32 formed in front of the striking member 31. An intermediate member 22 is held reciprocable along the middle bore portion 19 with its rear portion of a reduced diameter protruding into the cylinder 15. A single air replenishment port 34 and six air ports 35 are provided in the part of the peripheral wall of the cylinder 15 where the first air chamber 30 is formed. Similarly, six air vents 36 are provided in the part of the peripheral wall of the cylinder 15 where the second air chamber 32 is formed. The air replenishment port 34 replenishes the first air chamber 30 with air during operation. The air ports 35 are covered with the steel ring 28 only when the slide sleeve 16 is in the rear position (the position shown in FIG. 2), where the flange 16*a* is abutted on the front end of the cylinder 15. Furthermore, a plurality of wide slits 37 and narrow slits 38 is axially formed in the front portion of the slide sleeve 16 as best shown in FIG. 3. Meanwhile, the large bore portion 20 of the tool holder 17 includes six air passage holes 39 around the part thereof over the air vents 36. The large bore portion 20 additionally has six auxiliary holes 39*a* formed therein further toward the tool bit 17. As shown in FIGS. 1 and 3, the auxiliary holes 39*a* are axially displaced with respect to the air passage holes 39. The slits 37 and 38 are configured in such a manner as to be in pneumatic communication with the air vents 36 at all times wherever the slide sleeve 16 may be located between the forward and rear positions. Similarly, the air passage holes 39 and the auxiliary holes 39*a* are configured in such a manner as to remain at all times at all the time in pneumatic communication with the slits 37 and 38 regardless of their rotational positions, which are changeable as the tool holder 17 is rotated by the motor 9.

When pushed into the small bore portion 18 of the tool holder 17, the tool bit 7 comes into abutment with the intermediate member 33, which in turn pushes back the washer 26 and the rubber ring 27. Then, after the rubber ring 27 comes into abutment with the flange 16*a* of the slide sleeve 16, the slide sleeve 16 and the steel ring 28 are moved backward against the urge of the compression spring 29 to the position shown in FIG. 1. In this position, the air ports 35 are covered with the steel ring 28, when the piston 14 reciprocates, the first air chamber 30 functions as an air spring to pneumatically interlock the piston 14 with the striking member 31.. As the piston 14 reciprocates in this manner, the striking member 31 imparts hammer blows to the rear end of the intermediate member 33 in the second air chamber 32, which transmits the impacts of the blows to the tool bit 17. In the mean time, the second air chamber 32 is pneumatically communicated with the outside via the slits 37 and 38 of the slide sleeve 16, and the air passage holes 39 and the auxiliary holes 39*a* of the tool holder 17. The reciprocating motion of the slide sleeve 16 or the rotation of the tool holder 17 creates in the second air chamber 32 hardly any pneumatic repulsion which causes loss of the impacts of the blows. The washer 26 and the rubber ring 27 cushion and reduce the recoil of the tool bit 7 transmitted to the rest of the hammer drill 1.

Figure 4:
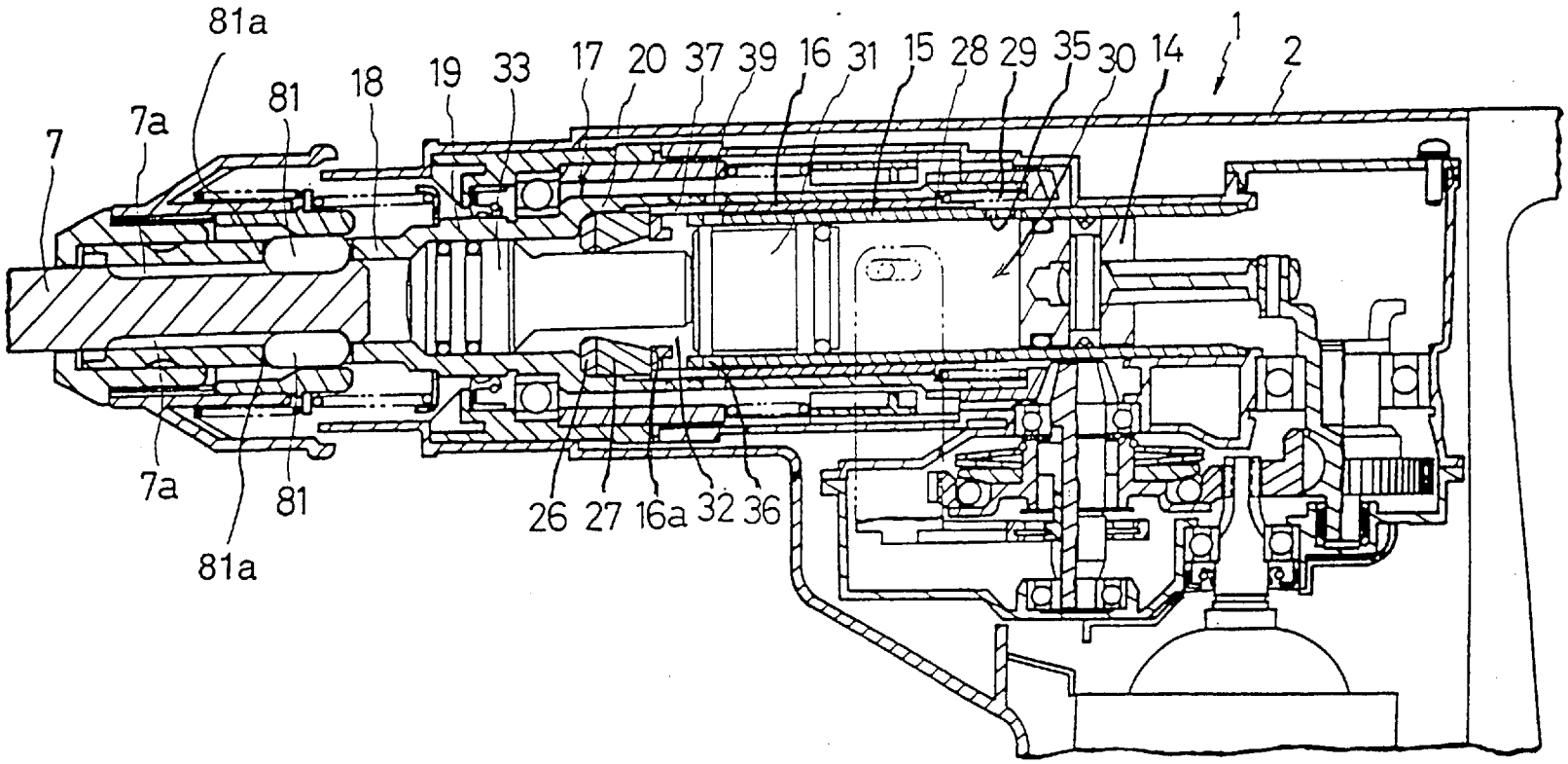
FIG. 4 is a vertical sectional view of the hammer drill shown in FIG. 1 during idling.

At the beginning of idling, when receiving a first idle blow from the striking member 31, the tool bit 7 is advanced until the end of each groove 7*a* comes to abutment with the roller 81 as shown in FIG. 4. Meanwhile, the front end of the intermediate member 33 abuts against the small bore portion 19 and the washer 26 and the rubber ring 27 abuts against the front end of the middle bore portion 19. At the same time, the slide sleeve 16 and the steel ring 28 also moves to the positions shown in FIG. 4 to uncover the air ports 35. This results in the loss of the air spring effect of the first air chamber 30 and pneumatic decoupling of the piston 14 from the striking member 31. The striking member 31., on the other hand, comes to a stop at the rear end of the intermediate member 33 in the forward position, thereby preventing any further idle strikes. The second air chamber 32, meanwhile, is in pneumatic communication with the outside via the air vents 36, the slits 37 and 38, and the air passage holes 39 or the auxiliary holes 39*a*, eliminating any pneumatic repulsion from the second air chamber 32 that pushes back the striking member 31 toward piston 14.

As described above, the cylinder 15 is fastened inside the housing 2 while the rotatable tool holder 17 is separately provided for transmitting rotation of the motor to the tool bit 7. Furthermore, to cover and uncover the air ports 35, the operation mechanism 3 reciprocates the slide sleeve 16, which is slidably mounted between the cylinder and the tool holder 17, thereby preventing idle strikes. Due to this structure, the cylinder 15 may be made of aluminum or some other light material, hence contributing to reduced weight and cost of the hammer drill 1.

As an alternative construction, the steel ring 28 may be formed integrally with the slide sleeve 16, although these two members are formed separately in this embodiment.

Furthermore, the number and/or shapes of the air vents 36, slits 37 and 38, and/or the air passage holes 39 or the auxiliary holes 39*a* may be modified to suit specific applications.

Figure 5:
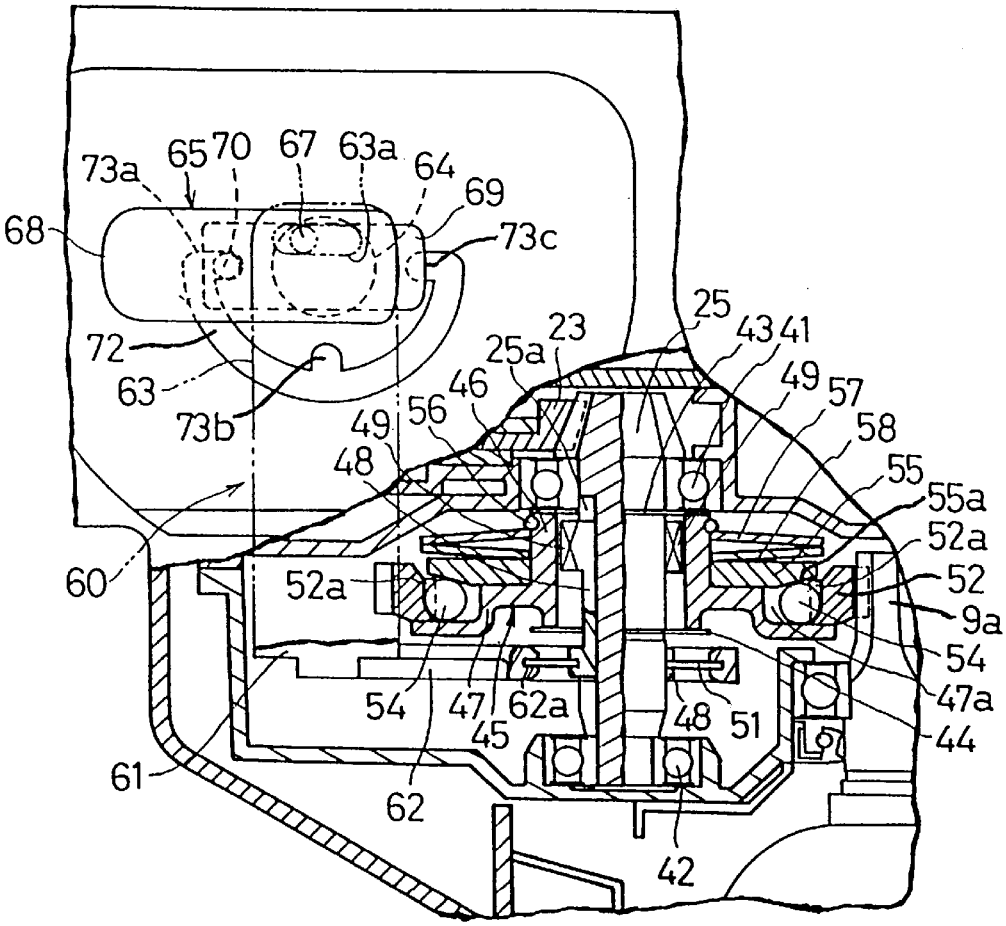
FIG. 5 is a partial cutaway sectional view of a transmission mechanism in accordance with the present invention.
Figure 6:
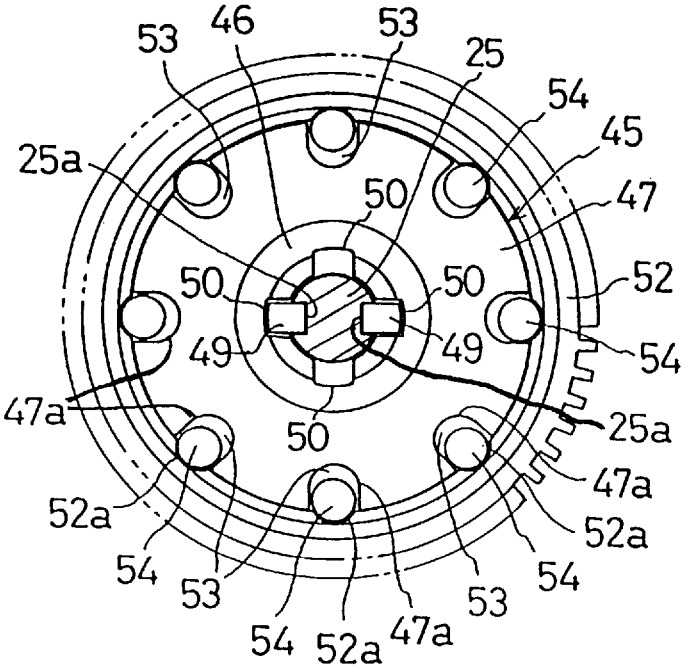
FIG. 6 is a plan view of the transmission mechanism shown in FIG. 5.

Referring now to FIG. 5, the transmission mechanism 40 will now be explained in detail. As described above, the shaft 25 is engaged with the bevel gear 23 and supported in parallel with the motor shaft 9*a* by the ball bearings 41 and 42. A sleeve 45 is rotatably mounted on the shaft 25 between washers 43 and 44, which prevent the sleeve 45 from moving vertically on the shaft 25. The sleeve 45 is composed of a cylindrical portion 46 and a flange portion 47 formed around the cylindrical portion 46. As shown in FIG. 6, the shaft 25 has a pair of diametrically opposed axial slide grooves 25*a* formed therein. A pair of change keys 48 are inserted through the washer 44 along the respective slide grooves 25*a* between the shaft 25 and the sleeve 45. Each change key 48 includes a lug 49 interposed between the washers 43 and 44, so that the vertical movement of the change keys 48 is restricted.

Figure 8:
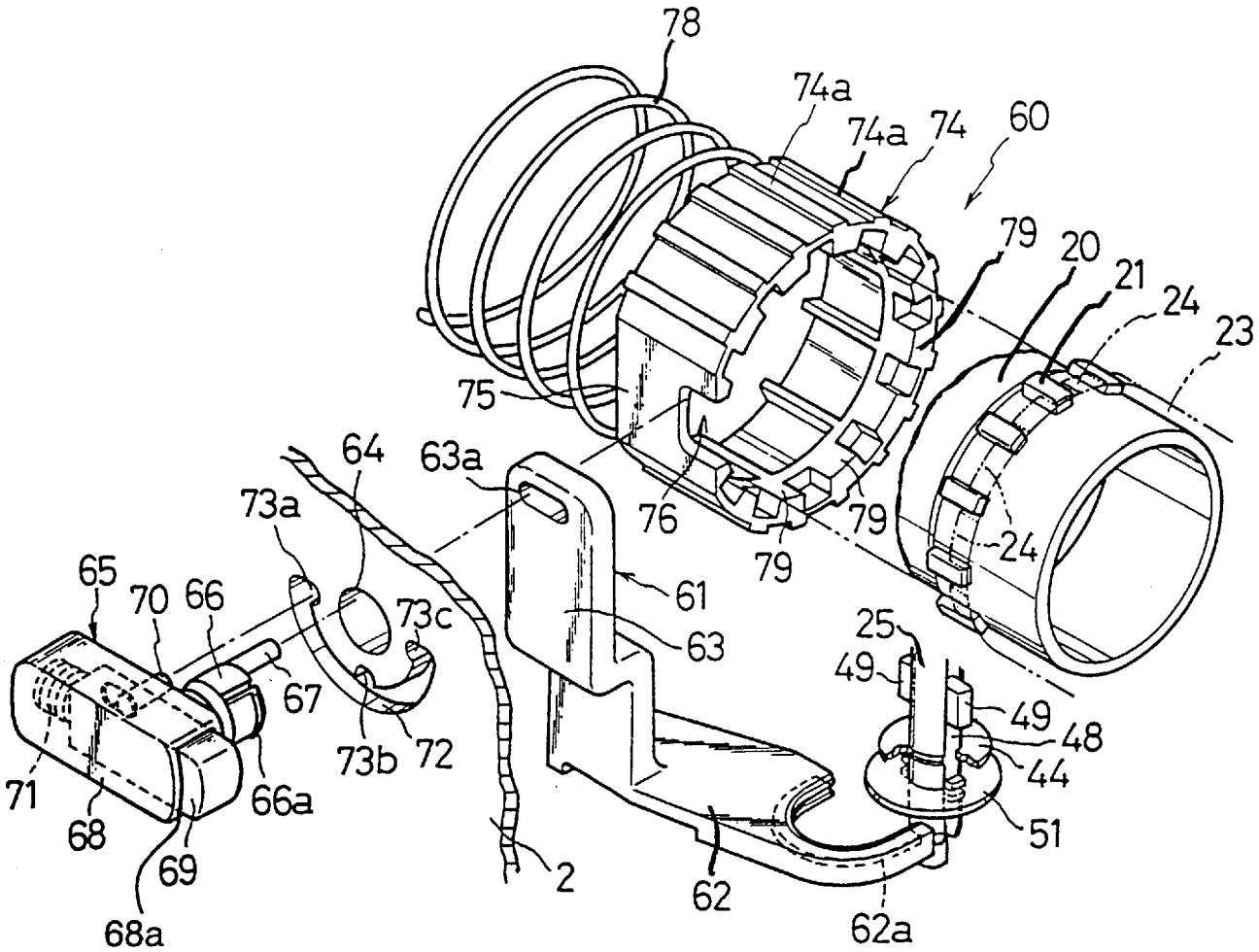
FIG. 8 is an exploded view of a change-over mechanism in accordance with the present invention.

As shown in FIG. 6, four recesses 50 are formed in the upper half of the inner wall of the cylindrical portion 46 of the sleeve 45. In the uppermost position of the change keys 48, the lugs 49 are engaged with a pair of diametrically opposed recesses 50, so that the sleeve 45 and the shaft 25 can rotates together as the sleeve 45 transmits rotation to the shaft 25. In the lowermost position of the change keys 48, on the other hand, the lugs 49 are disengaged from the recesses 50, so that the rotation of the sleeve 45 can no longer be transmitted to the shaft 25. As shown in FIGS. 5 and 8, the two change keys 48 are fastened together to the shaft 25 with a connecting ring 51 which is fitted in a groove 62*a* formed in a holder 62 of a change link 61. Thus constructed, the change keys 48 are vertically movable together with the vertical movement of the change link 61.

A helical gear 52 is coaxially mounted around the flange portion 47 and meshed with the motor shaft 9*a*. Eight equally spaced connection recesses 47*a* are formed in the circumference of the flange portion 47. Meanwhile, eight corresponding inwardly round connection surfaces 55*a* are formed on the inner surface of the helical gear 52. The connection recesses 47*a* and the connection surfaces 52*a* in combination define eight radially extending clutch grooves 53 in each of which a movable single ball 54 is placed. Mounted over the flange portion 47 formed on the cylindrical portion 46 is a shrouding ring 55 for holding the balls 54 in place. The shrouding ring 55 includes an radially tapered lower surface 55*a*. The shrouding ring 55 are downwardly urged by a pair of belleville springs 57 and 58 slipped on the cylindrical portion 46. The springs 57 and 58 are compressed and retained with a clip 56 fitted around the cylindrical portion 46 at the top end of the spring 57. The tapered surface 52*a* of the shrouding ring 55, under the pressure from the springs 57 and 58, radially urges the balls 54 in the clutch grooves 53, so that the balls 54 connect the recesses 47*a* with the connection surfaces 52*a*, thereby allowing the helical gear 52 and the sleeve 45 to rotate integrally as the motor 9 rotates. In other words, the vertical pressure exerted by the belleville springs 57 and 58 is converted into radial pressure on the balls 54 by the shrouding ring 55. Thus, the maximum torque that can be transmitted to the shaft 25 corresponds to the radial pressure exerted by the belleville springs 57 and 58.

In the operation of the transmission mechanism 40 thus constructed, when the change link 61 is in the uppermost position, the lugs 49 are engaged with two opposite recesses 50. When the motor shaft 9*a* rotates the helical gear 52 in this state, both the helical gear 52 and the sleeve 45 are rotated since the shrouding ring 55 radially urges the balls 54 in the respective clutch grooves 53 to connect the helical gear 52 and the cylindrical portion 47 of the sleeve 45. The shaft 25 is then rotated since the lugs 49 of the change keys 48 are engaged with two of the recesses 50. Subsequently, the rotation of the shaft 25 is transmitted to the bevel gear 23, thereby rotating the tool holder 17.

Figure 7:
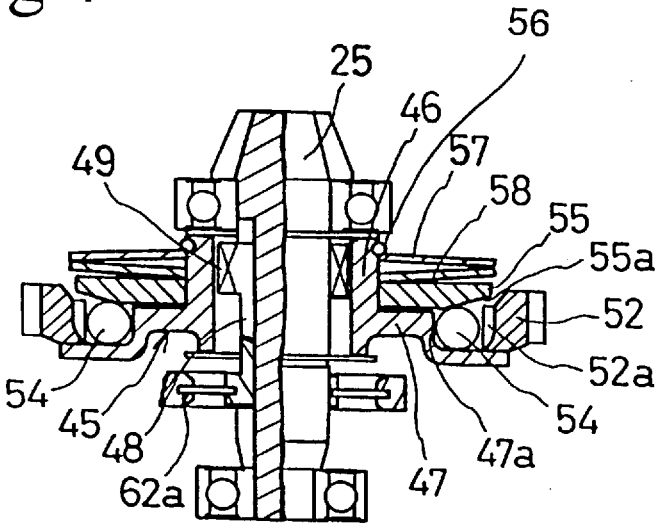
FIG. 7 is a partial sectional elevational view of the transmission mechanism shown in FIG. 5.

If the rotational resistance of the tool holder 17 exceeds the maximum transmittable torque corresponding to the pressure of the belleville springs 57 and 58 during the rotation of the tool holder 17, the balls 54 in the clutch grooves 53 are shifted toward the shaft 25 against the pressure of the shrouding ring 55, as shown in FIG. 7. This displacement of the balls 54 breaks the connection of the recesses 47*a* with the surfaces 52*a*, so that the rotation of the helical gear 52 is no longer transmitted to the flange portion 47. As should be clear from the foregoing explanation, the transmission mechanism 40 thus serves as an overload-prevention clutch. Generally, a belleville spring exhibits increasingly smaller deflection as the load approaches the elastic limit of the spring. In this embodiment, since the axial pressure of the belleville springs 57 and 58 is converted to the radial pressure using the tapered surface 55*a* of the shrouding ring 55 and the balls 54 in the clutch grooves 53, the pressure on the shrouding ring 55 can be set in the load range where the deflection of the springs 57 and 58 is small. This structure provides stable, even torque for each unit of the hammer drill 1, eliminating the need for a pressure adjustment screw and additional manufacturing steps of mounting such a screw.

It should be apparent to those skilled in the art that the number or the shapes of the belleville springs 57 and 58 or the clutch grooves 53 may be changed or modified without departing from the spirit of the present invention. Furthermore, the transmission mechanism 40 can be applied to electric tools other than the hammer drill.

Figure 9:
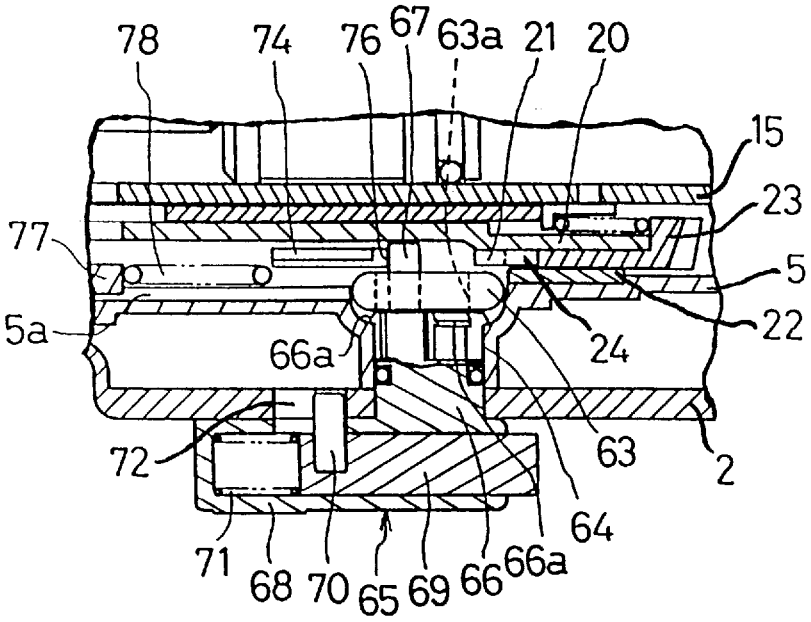
FIG. 9 is a traverse sectional plan view of the change-over mechanism shown in FIG. 8.

The change-over mechanism 60 will now be explained in detail with specific reference to FIGS. 5, 8, and 9. The change link 61 includes the holder 62 gripping the change keys 48 and a link portion 63 provided upright on the holder 62. The link portion 63 has a horizontally elongated slot 63*a* provided in the upper end thereof, which an eccentric pin 67 protruding from a mode selector switch 65 penetrates. The mode selector switch 65 includes a cylindrical portion 66, a retainer 66*a* provided on one end of the cylindrical portion 66, a box-like shaped finger grip 68 provided with an opening 68*a* on one side, a stopper 69 movably inserted into the finger grip 68, a pin 70, and a compression spring 71. The cylindrical portion 66 is rotatably inserted into a through-hole 64 formed in the housing 2 and the crank housing 5, with the retainer 66*a* maintaining the cylindrical portion 66 in place. The cylindrical portion 66 is connected to the finger grip 68 near the opening 68*a* outside the housing 2. The inserted stopper 69 is urged toward the opening 68*a* by the compression spring 71. The pin 70, orthogonally mounted on the stopper 69, penetrates a semi-circular slit 72 in the housing 2 to prevent the stopper 69 from falling out. The slit 72 is provided with three notches 73*a*, 73*b*, and 73*c* cut toward the center at both ends (0 and 180 degree positions) and the middle point (90 degree position). While the pin 70 can be guided along the slit 72, the pressure of the compression spring 71 allows the pin 70 to be engaged with and fixed in any of the notches 73*a*, 73*b*, and 73*c*.

A lock ring 74 is fitted over the large bore portion 20 of the tool holder 17. The lock ring 74 has on the periphery a plurality of pinions 74*a* for engaging axially extending teeth 5*a* formed on the inner surface of the crank housing 5. The lock ring 74 is urged backward by a compression spring 78 interposed between the lock ring 74 and a bearing retainer 77 mounted in the bearing cap. The Lock ring 74 also has a square recess 76 formed in a chamfer 75, with which the eccentric pin 67 of the mode selector switch 65 is engaged via the slot 63*a* of the change link 61. Furthermore, a plurality of teeth 79 is formed around the inner rear circumference of the lock ring 74 for engaging the front halves of the matching protrusions 21 on the tool holder 17. FIG. 5 shows the position of the eccentric pin 67 with the pin 70 in the notch 73*a* (the 0 degree position). When the pin 70 is in the notch 73*b* (the 90 degree position), the eccentric pin 67 is moved to a lower left position. With the pin 70 in the notch 73*c* (the 180 degree position), the eccentric pin 67 is moved to a Lower right position. The change link 61 and the change keys 48 are moved as the eccentric pin 67 is moved vertically in this manner. Similarly, the lock ring 74 is moved in the axial direction according to the axial movement of the change link 61 to engage or disengage the teeth 79 with the protrusions 21.

Figure 10C:
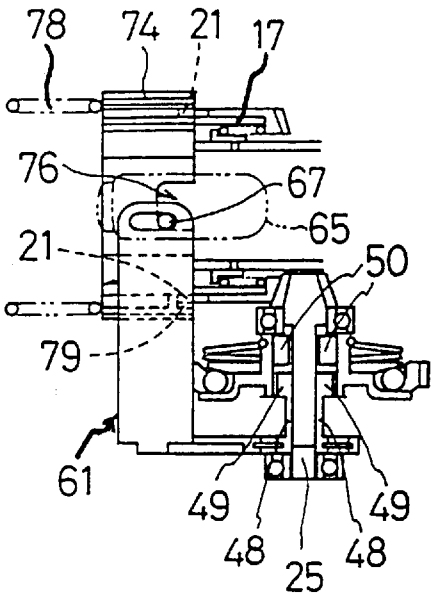
FIG. 10C shows the transmission mechanism and the change-over mechanism in the hammer only mode.

In the change-over mechanism 60 thus constructed, three operational modes can be selected by rotating the mode selector switch 65. In the 0 degree position as shown in FIG. 10A, the eccentric pin 67, located in its upper left position, leaves the lock ring 74 disengaged from the protrusions 21. At the same time, the change link 61 is located in the uppermost position, thus engaging the lugs 49 with two of the recesses 50. In this position, therefore, a rotation plus hammer mode is selected in which the piston 14, the striking member 31, and the intermediate member 33 are pneumatically actuated to impart hammer blows while the tool holder 17 is driven to rotate.

Figure 10B:
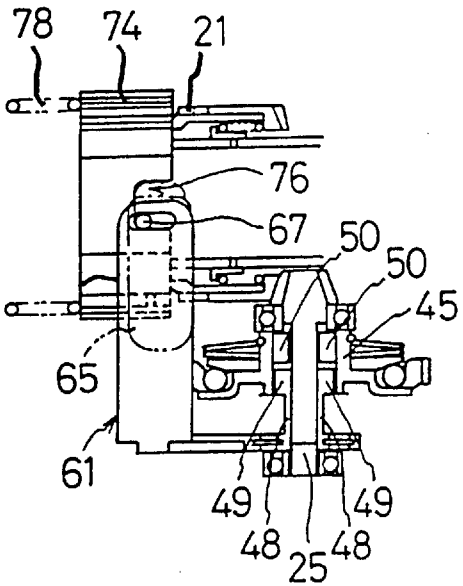
FIG. 10B shows the transmission mechanism and the change-over mechanism in the neutral mode.
Figure 10A:
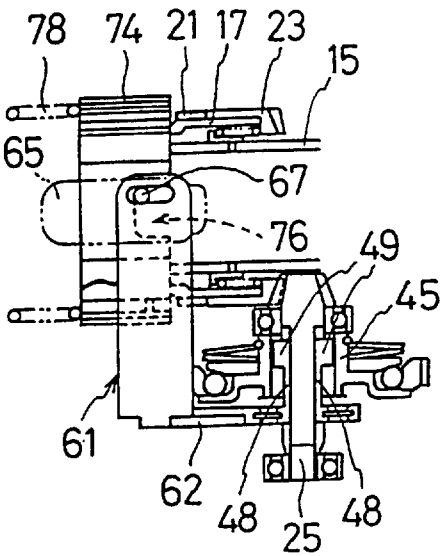
FIG. 10A shows the transmission mechanism and the change-over mechanism in a rotation plus hammer mode.

If the mode selector switch 65 is rotated counterclockwise 90 degrees as shown in FIG. 10B, the eccentric pin 67 is shifted to its lower left position, still Leaving the lock ring 74 disengaged from the protrusions 21. However, the change link 61 is moved to its Lowermost position. Since this disengages the lugs 49 from the two recesses 50, the rotation of the sleeve 45 is no longer transmitted to the shaft 25. In this position, therefore, hammering can still be performed while the tool holder 17, no longer driven to rotate by the motor 6, is manually freely rotatable in either direction. This operational mode is referred to as the neutral mode hereinafter.

If the mode selector switch 65 is rotated further counterclockwise by another 90 degrees to the 180 degree position as shown in FIG. 10C, the eccentric pin 67 Is shifted to its lower right position, bringing the lock ring 74 backward into engagement with the protrusions 21 to prevent the rotation of the tool holder 17. Since the change link 61 remains in the lowermost position, the rotation of the sleeve 45 is not transmitted to the shaft 25 while hammer blows are still available. This operational mode is referred to as the hammer only mode hereinafter. As an example of the use of these modes, if the angle of the tool bit 7 to the work piece needs to be fixed, it can be easily achieved by rotating the tool holder 17 to obtain the desired angle in the neutral mode and then further rotating the mode selector switch 65 to place the operation in the hammer only mode, where only hammering is available without rotating the tool bit 7.

As explained above, according to the change-over mechanism 60 of the preferred embodiment, the transmission of rotation of the motor 6 to the shaft 25 and the locking of the tool holder 17 are performed by two separate members, i.e., the sleeve 45 and the lock ring 74. One of the advantages of such a construction is each of these two members can be optimally designed to withstand the specific range of load imposed on the member to achieve an increased durability. This construction is more economical than a design using a single member because, should one of the members be damaged, there is no need of replacing the other. Moreover, high operability is ensured by the efficiency of the construction in which the eccentric pin 67 is smoothly interlocked with the lock ring 74 and the change keys 48.

In the foregoing embodiment, the lock ring 74 is moved in the axial direction and the change keys 48 is moved in the direction orthogonal to the axial direction in order to effect their respective switchover functions. However, modification is possible to move the change keys 48 also in the axial direction, depending on the structure of the transmission mechanism 40.

In the change-over mechanism 60, when sliding the change keys 48 upward by operating the mode selector switch 65, a mode change can be made smoothly and quickly if the lugs 49 are appropriately aligned with the recesses 50. If not or if the sleeve 45 happens to be rotating, the lugs 49 cannot engage the recesses 50 immediately, preventing the mode selector switch 65 from rotating smoothly and thus the change link 61 from smoothly moving upward.

Figure 11:
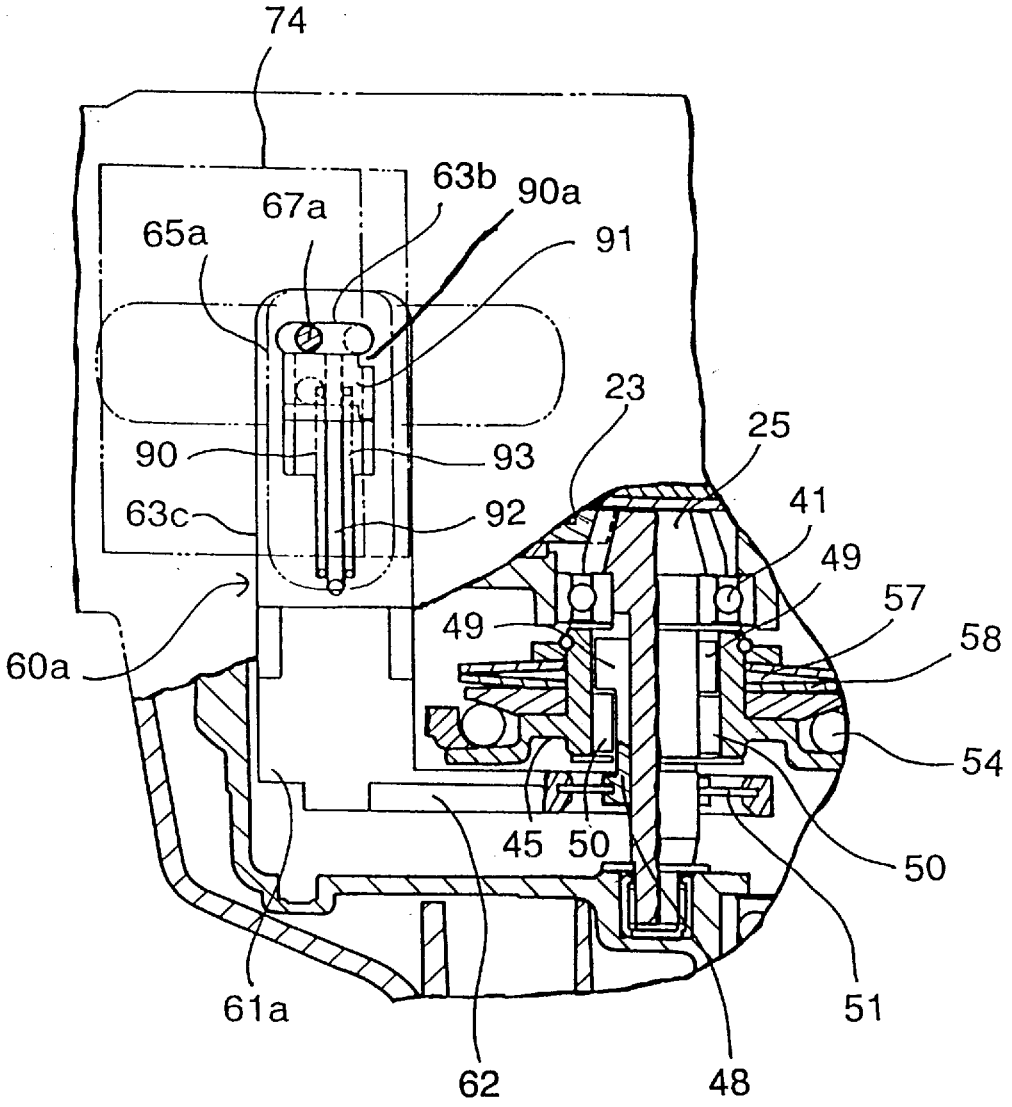
FIG. 11 is a partial cutaway sectional view of a change-over mechanism in accordance with the present invention.

A change-over mechanism 60*a* as shown in FIG. 11, on the other hand, can provide improved operability for changing the operation mode of the hammer drill 1.

The change-over mechanism 60*a* differs from the change-over mechanism 60 in that a link portion 63*c* includes a downwardly extending slide hole 90 formed therein on a slot 63*b,* where an eccentric pin 67*a* of a mode selector switch 65*a* penetrates the change link 61. The change-over mechanism 60*a* further includes a vertical slide plate 91 fitted in the slide hole 90. The slot 63*b* is connected with the slide hole 90 along the upper end of the slide plate 91 when the slide plate 91 is in its uppermost position. A guide pin 92 is also provided in the slide hole 90 penetrating the slide plate 91 at its approximate center. Moreover, a compression spring 93 is fitted over the guide pin 92 upwardly urging the slide plate 91. Also provided is a stopper 90*a* formed at the upper right end of the slide hole 90 for limiting the uppermost position of the slide plate 91.

The recesses 50 in this alternative construction are formed on the opposite, lower end of the sleeve 45 instead of the upper end as in the foregoing change-over mechanism 60 as shown in FIG. 5. Accordingly, the change keys 48 are engaged with these lower recesses 50 when the change link 61*a* is moved downward. This means that the position of the mode selector switch 65*a* is reversed to obtain the same operation mode of the hammer drill 1. Specifically, the rotation plus hammer mode is established at the lower left position of the eccentric pin 67*a* with the mode selector switch 65*a* rotated to the horizontal right as shown in FIG. 11. The neutral mode is established at the upper left position of the eccentric pin 67*a* with the mode selector switch 65*a* positioned vertically, while the hammer only mode is established at the upper right position of the eccentric pin 67*a* with the mode selector switch 65*a* rotated to the horizontal left.

Also in this alternative construction, if the recesses 50 of the sleeve 45 are not properly located, the change link 6l*a* and the change keys 48 cannot be lowered when switching from the neutral mode to the rotation plus hammer mode by turning the mode selector switch 65*a* 90 degrees from the vertical position to the horizontally right position. However, the slide plate 91 is slid downward against the urge of the compression spring 93 by the downward pressure exerted by the eccentric pin 67*a.* Although the change link 6l*a* is not lowered, the eccentric pin 67*a,* while pushing the slide plate 91, is allowed to travel downward in the slide hole 90 to the position where the rotation and hammer mode can be obtained. Since the slide plate 91 continues to press down the change link 61*a,* as the motor 9 rotates the sleeve 45, the lugs 49 eventually engage a pair of the recesses 50. Upon engagement, the change keys 48 and the change link 61*a* move down to their respective Lowermost positions. Meanwhile, the slide plate 91 returns to its uppermost position, abutting against the stopper 90*a,* thus completing the mode change operation.

In this alternative construction, even when the change keys 48 does not initially engage the sleeve 45, the downward movement of the slide plate 91 permits movement of the eccentric pin 67*a* to ensure smooth and quick rotation of the mode changeover switch 65*a.*

In the alternative construction, the lugs 49 engage the sleeve 45 on the opposite end as in the foregoing embodiment, so that the eccentric pin 67*a* is allowed to travel downward while pushing down the slide plate 91 in the change Link 61*a.* A similar construction can be adopted in the embodiment if the link portion 63 is extended upward to accommodate a slide plate and other required parts in a slide hole, such as those in the alternative construction.

According to the present invention, the transmission of rotation to the tool bit and the prevention of idle hammering blows are carried out by two separate members, namely a tool holder and a slidable cylinder, in a hammer drill.. Due to this arrangement, the slidable cylinder can be made of a light material, such as aluminum, thereby reducing the weight and the cost of the hammer drill.

As there may be many other modifications, alterations, and changes without departing from the scope or spirit of essential characteristics of the present invention, it is to be understood that the above embodiment is only illustrative and not restrictive in any sense. The scope or spirit of the present invention is limited only by the terms of the appended claims.

What is claimed is:

1. A hammer drill, comprising:

a motor for providing drive power for the hammer drill;

a cylinder fixed in a housing;

a rotatable tool holder for receiving and integrally rotating a tool bit therewith, the tool holder being provided with an engagement member;

a rotation transmission mechanism for transmitting the rotation of the motor to the tool holder, the rotation transmission mechanism provided between the tool holder and the motor;

transmission switching means included in the rotation transmission mechanism for, by the movement thereof, selecting one of two operational states in one state of which the rotation of the motor is transmitted to the tool holder and in the other state of which the rotation of the motor is not transmitted to the tool holder;

a locking member movable between a position in which the locking member is engaged with the engagement member of the tool holder and another position in which the locking member is disengaged from the engagement member; and mode change-over means for moving the transmission switching means and the locking member, the mode change-over means connecting the transmission switching means with the locking member;

whereby the operation mode of the hammer drill can be selected by operating the mode change-over means from:

a rotation plus hammer mode in which the transmission switching means is moved to a position where the transmission switching means is able to transmit the rotation of the motor to the tool holder and the locking member is moved to a position where the locking member is disengaged from the engagement member of the tool holder;

a neutral mode in which the transmission switching means is moved to a position where the transmission switching means is unable to transmit the rotation of the motor to the tool holder and the locking member is moved to a position where the locking member is disengaged from the engagement member of the tool holder; and a tool holder lock-up mode in which the transmission switching means is moved to a position where the transmission switching means is unable to transmit the rotation of the motor to the tool holder and the locking member is moved to a position where the locking member is engaged with the engagement member of the tool holder.

2. A hammer drill in accordance with claim 1, wherein the mode change-over means comprises:

a mode selector switch connected with the locking member for, when operated, moving the locking member to one of the two positions, in one of which the locking member is engaged with the engagement member of the tool holder and in the other of which the locking member is disengaged from the engagement member of the tool holder; and a linking member with one end connected to the mode sector switch and the other end connected to the transmission switching means for, by operating the mode selector switch, moving the transmission switching means to one of the two positions, in one of which the transmission switching means is able to transmit the rotation of the motor to the tool holder and in the other of which the transmission switching means is unable to transmit the rotation of the motor to the tool holder.

3. A hammer drill in accordance with claim 2, wherein the rotation transmission mechanism comprises a first gear for transmitting the rotation of the motor and a rotating shaft around which the first gear is coaxially rotatably fitted, the rotating shaft being engaged orthogonally with the tool holder via a second gear for transmitting the rotation of the motor to the tool holder, the transmission switching means is a key member integrally rotatable with the rotating shaft and slidably movable along the rotating shaft, the key member being engageable with the first gear, the locking member is a sleeve coaxially mounted around the tool holder and movable in the axial direction thereof, the mode selector switch includes an eccentric pin orthogonally engaged with the sleeve, the mode selector switch is rotatably supported in the housing of the hammer drill, and one end of the linking member is penetrated by the eccentric pin while the other end of the linking member is connected with the key member, whereby the circular motion of the eccentric pin caused by the rotation of the mode selector switch causes the sleeve to move the sleeve axially to one of the two positions, in one of which the sleeve is engaged with the engagement member and in the other of which the sleeve is disengaged from the engagement member, and also causes the linking member to move in parallel to the rotating shaft to one of the two positions, in one of which the linking member causes the key member to be engaged with the first gear and in the other one of which the linking member causes the key member to be disengaged from the first gear.

4. A hammer drill in accordance with claim 3, wherein one end of the first gear has a plurality of openings formed therein and the key member has a plurality of protrusions formed thereon, the flanges being engageable with the openings of the first gear for transmitting the rotation of the motor to the tool holder when the key member is moved vertically by vertical movement of the linking member.

5. A hammer drill in accordance with claim 3, wherein the linking member is an approximately L-shaped member comprising a horizontally extended holder connected with the key member and a link connected to the holder land extended from the holder in parallel with the rotating shaft, the upper portion of the link being penetrated by the eccentric pin, whereby the horizontal component of the circular motion of the eccentric pin caused by the rotation of the mode selector switch controls the axial movement of the sleeve and the vertical component of the circular motion of the eccentric pin caused by the rotation of the mode selector switch controls the movement of the key member.

6. A hammer drill in accordance with claim 5, further comprising an urging means for urging the sleeve in the rearward direction and wherein the part of the sleeve engaged with the eccentric pin is a cut-out formed in the rear end thereof, the cut-out having such a width as to permit the vertical movement of the eccentric pin.

7. A hammer drill in accordance with claim 5, wherein the part of the linking member engaged with the eccentric pin is a horizontal slot for permitting the horizontal movement of the eccentric pin.

8. A hammer drill in accordance with claim 5, further comprising a yielding mechanism provided on the portion of the linking member which is engaged with the eccentric pin, the yielding mechanism permitting vertical movement of the eccentric pin caused by the rotation of the mode selector switch when a load is applied to the linking member in vertical movement during a mode change to the rotation plus hammer mode.

9. A hammer drill in accordance with claim 8, wherein the yielding mechanism comprises a slide piece slidable in parallel with the rotating shaft, the slide piece partially forming the part engaged with the eccentric pin, and an urging means for urging the slide piece in the direction opposite to the vertical movement of the eccentric pin.

* * * * *